US005188485A

United States Patent [19]

Forster et al.

[11] Patent Number: 5,188,485

[45] Date of Patent: Feb. 23, 1993

[54] FOUNDATION PILE OF REINFORCED CONCRETE

[75] Inventors: Richard F. Forster, Schwaig; Friedemann A. Rudersdorf, Neumarkt, both of Fed. Rep. of Germany

[73] Assignee: Pfleiderer Verkehrstechnik GmbH, Neumarkt, Fed. Rep. of Germany

[21] Appl. No.: 717,239

[22] Filed: Jun. 18, 1991

[30] Foreign Application Priority Data

Jun. 29, 1990 [DE] Fed. Rep. of Germany ..... 4020757

[51] Int. Cl.[5] ..... E02D 5/30; E02D 5/56; E02D 7/22; E02D 7/28

[52] U.S. Cl. ..... 405/232; 405/252.1; 405/253; 405/256

[58] Field of Search ..... 405/231, 232, 249, 252.1, 405/253–256; 173/141, 163; 175/323; 411/403, 404, 919; 166/177

[56] References Cited

U.S. PATENT DOCUMENTS

| | | | |
|---|---|---|---|
| 137,744 | 4/1873 | West | 175/323 |
| 2,080,181 | 5/1937 | Miller | 175/323 X |
| 2,088,759 | 8/1937 | Rassieur | 175/323 |
| 2,210,296 | 8/1940 | Kittrell et al. | 175/323 |
| 2,372,269 | 3/1945 | Golan | 411/919 X |
| 3,178,210 | 4/1965 | Dickinson | 175/323 X |
| 3,295,572 | 1/1967 | Wing | 411/403 X |
| 3,369,441 | 2/1968 | Kosar | 411/919 X |
| 4,239,419 | 12/1980 | Gillen | 405/232 |
| 4,614,462 | 9/1986 | Itou | 405/232 |
| 4,708,530 | 11/1987 | Faber | 405/252.1 |

FOREIGN PATENT DOCUMENTS

| | | | |
|---|---|---|---|
| 2504168 | 10/1982 | France | 405/254 |
| 5265 | 12/1881 | United Kingdom | 411/403 |

*Primary Examiner*—Dennis L. Taylor
*Assistant Examiner*—John A. Ricci
*Attorney, Agent, or Firm*—Jordan and Hamburg

[57] ABSTRACT

A foundation pile of reinforced, preferably prestressed concrete having external screw threads and an interior cavity for the engagement of the driver rod applying the torque, at least two flat steel bars being fastened axially parallel in the pile wall to approximately equal angular spacing, and extending by about half of their width freely into the cavity serving for the engagement of the driver rod.

17 Claims, 2 Drawing Sheets

FOUNDATION PILE OF REINFORCED CONCRETE

The invention relates to a foundation pile of reinforced, preferably prestressed concrete having external screw threads and an interior cavity for engagement by the driver rod applying the torque.

The preparation of such piles involves considerable difficulties based, on the one hand, on the complicated shaping due to the external screw thread, but on the other hand also based on the exacting quality requirements arising chiefly out of the forces that must be withstood as the pile is screwed into the ground. No less problematical is the task of producing such foundation piles suitable for withstanding the necessary torque and doing so at reasonable cost. In general, the interior cavity is provided with a polygonal cross section to be engaged by a driver rod of similar shape. This configuration, however, extremely complicates the preparation of such piles. Less problematical in this regard is the use of a steel plate applied to the head of the pile and having an opening matching the external shape of the driver rod. The use of a steel head plate, however, is extraordinarily expensive. Initially it has to be fastened to the pile, but after the pile has been driven in and is in use the head plate can no longer be used.

Consequently attempts have been made to design foundation piles of the kind described above such that they can be made inexpensively using the well-known centrifugal casting technique, and in a quality which cannot be equaled by the methods of manufacture used heretofore. The important object is to improve the quality of the piles such that the surface quality will be decidedly improved and a high degree of freedom from cracks will be achieved. These advantages are achieved by the use of the centrifugal casting process and the prestressing technique, which result in a foundation pile with a perfectly centered interior cavity of circular cross section. In order then, however, to apply the necessary torque with the driver rod, at least two flat steel bars are fastened axially parallel in the wall of the pile with an approximately equal angular spacing, with half their width reaching into the interior cavity and serving for engagement by the driver rod.

The measure taken in accordance with the invention sets out from the fact that such flat steel bars can be fixed precisely in the centrifugal casting mold without great difficulty, so that, when the mixture is centrifuged an interior chamber of perfectly circular cross section is produced virtually automatically, and the flat steel bars become anchored in the wall of the pile such that half of their width is embedded in the wall and the other half extends into the interior cavity of the pile. A pile made in this manner has all the advantages of the centrifugal casting technique. Also, the screw threads can be made in a centrifugal casting mold with a quality previously unknown.

In the simplest case, two flat bars are set in the wall diametrically opposite one another. Of course, three bars set 120° apart could also be used, or a greater number of bars. Which method is given preference will depend on the special requirements of the individual case.

The invention opens up the possibility of simply disposing the flat steel bars in the area bearing the external screw threads. As it is known, the torque in this manner can be transmitted especially well to the pile. Another alternative is for the flat steel bars to be disposed in the upper end part of the pile. This configuration permits easier handling in the driving of the pile and permits the use of a shorter driver rod.

It lies in the scope of the invention, in the case of a foundation pile with a foot plate bearing cutters, to fasten, preferably to weld, the flat steel bars to this foot plate. The torque that is to be applied for driving then acts directly through the foot plate on the foot of the foundation pile. Another alternative, however, is embodied in the independent inventive idea of fastening driving projections to the inside surface of the foot plate facing the interior cavity in order to engage the driver rod. This arrangement is the same as the embodiment first referred to, but in this case the flat steel bars projecting from the pile wall into the interior cavity take up only an extremely short length which is seen in the projections fastened to the foot plate. It is obvious that in this case a driver rod of correspondingly great length is necessary, but this has the advantage of better transmission of force to the tip of the pile.

In further development of the invention, notches are provided on the flat steel bars in the inwardly projecting portion in the area of their upper end for engagement by outer projections created on the driver rod. In this embodiment the driver rod is introduced into the interior of the pile until the projections on the driver rod are opposite notches of the flat steel bars. By turning the driver rod slightly, the projections enter the notches and produce a connection between the driver rod and the flat steel bars somewhat on the principle of the bayonet coupling. In this manner, tensile forces can be transmitted from the driver rod to the foundation pile so as to prevent the pile from being excessively tightened when the torque is applied to it. This renders obsolete the formerly common eyes on the head of the foundation pile which were engaged by traction means for the purpose of applying a traction force to the pile. This greatly simplifies handling when installing such foundation piling.

In further development of the basic idea of the invention, the driver rod is configured so that it approximately fills the interior cavity of the pile and has longitudinally running grooves for engaging the flat steel bars. It is obvious that these grooves and their arrangement correspond to the number and position of the flat steel bars in the interior of the pile. In this embodiment the torsion force is spread out over a considerable length of the pile. In an alternative configuration, however, the diameter of the driver rod is smaller than the radial distance between the flat steel bars, and external drivers are disposed on the driver rod for tangentially contacting the flat steel bars and/or engaging the notches in them. In the former case a rather spot contact is made between the driver rod and the flat steel bars anchored in the wall of the pile.

The invention lastly provides that the flat steel bars embedded in the wall are held at their outer circumference by a plurality of connecting rings spaced apart axially.

Additional features, details and advantages of the invention will appear in the following description of some preferred embodiments of the invention as well as in the drawings.

DESCRIPTION OF THE PREFERRED EMBODIMENTS

Figure 1:
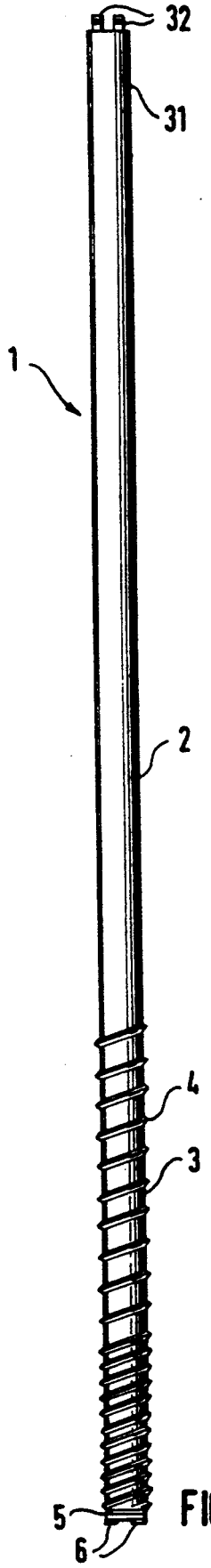
FIG. 1 is a side view of a foundation pile.
Figure 2:
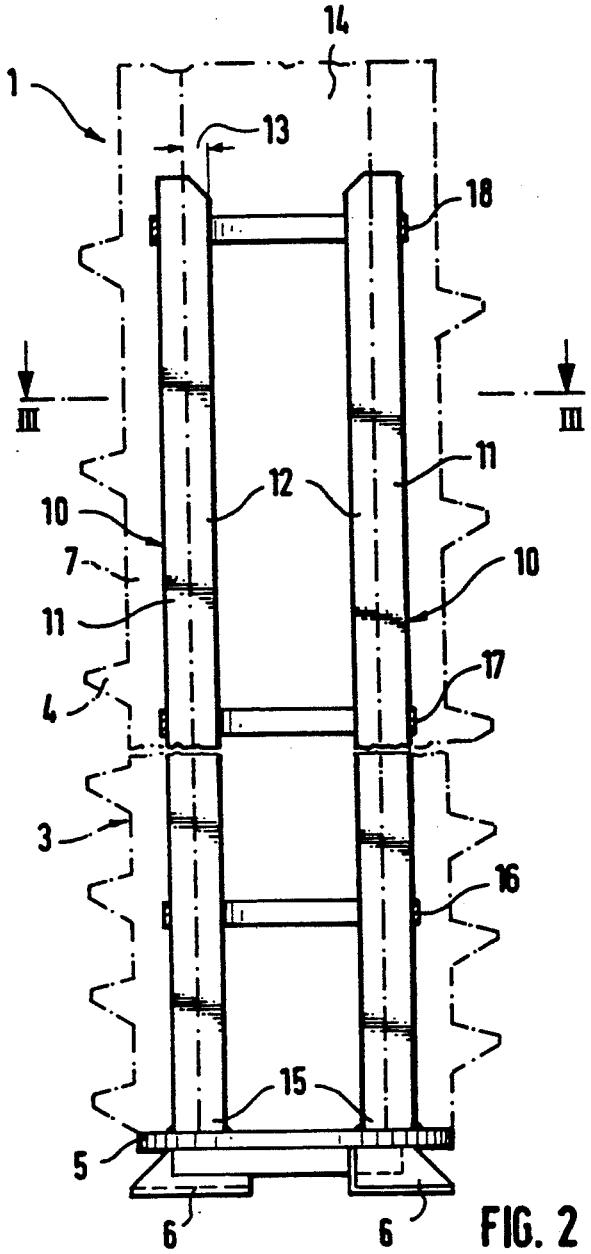
FIG. 2 shows the bottom end of a foundation pile, also in section.
Figure 3:
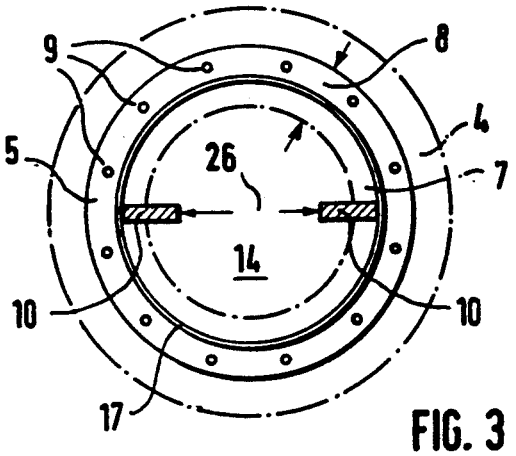
FIG. 3 is a section taken along line III—III in FIG. 2.

The foundation pile 1 consists of a shaft 2 of concrete. It is made by the centrifugal casting method and has in the area of its bottom end 3 an external thread 4 and at its bottom butt end a foot plate 5 on which cutters 6 or the like can be fastened. On the head 31 of the pile 1 two eyes 32 are provided in the embodiment here shown, which serve for the handling of the pile 1. The wall 7 of the pile 1 has, in the case of the embodiments shown in the figures, a thickness 8, outside of which, in the embodiment shown in the drawing, the thread spirals 4 extend outward in the area of the bottom end 3. The wall 7 is provided with reinforcing bars 9. In the area of the bottom end 3 bearing the threads 4, two flat steel bars 10 are mounted in the wall such that their outer half 11 is embedded into the wall 7, while their inner half 12 extends by the width 13 into the interior cavity 14 of the pile 1. The flat steel bars 10, in the embodiment here represented, are welded at their bottom ends 15 to the foot plate 5. They are furthermore joined together by three steel rings 16, 17 and 18 disposed at a distance apart and thus they are fixed in relation to one another. The angular spacing of the two flat steel bars 10 amounts, in the embodiments represented in the drawing, to 180°.

Figure 4:
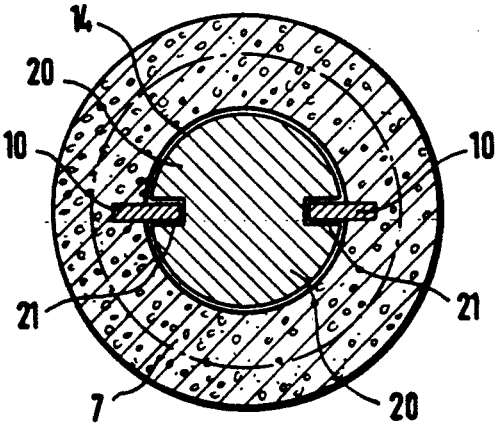
FIG. 4 shows a first.
Figure 5:
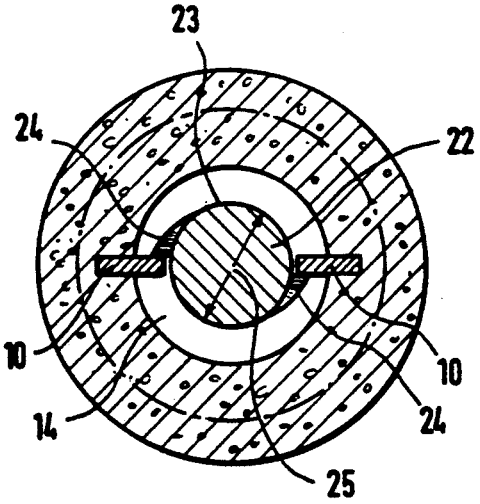
FIG. 5 a second embodiment of the driver rods for cooperation with the flat steel bars extending into the internal cavity.

A torque is applied to the foundation pile 1 through the driver rod 20, which in the embodiment shown in FIG. 4, approximately fills the interior cavity 14. On each of two diametrically opposite sides the driver rod is provided with a notch 21 running longitudinally, which is brought into alignment with the flat steel bars 10 when the driver rod 20 is lowered, so that the bars 10 will engage the grooves 21 in the driver rod when the latter is lowered. In the embodiment shown in FIG. 5, however, a substantially thinner driver rod 22 is used, on whose outer wall 23 two oppositely situated outer projections 24 are fastened, which, after the driver rod 22 has been lowered sufficiently deep engage the flat steel bars 10 and can transfer their torque to these bars and thus to the shaft 2 of the pile 1. The diameter 25 of this driver rod 22 is slightly smaller than the distance 26 between the two flat steel bars 10.

Figure 6:
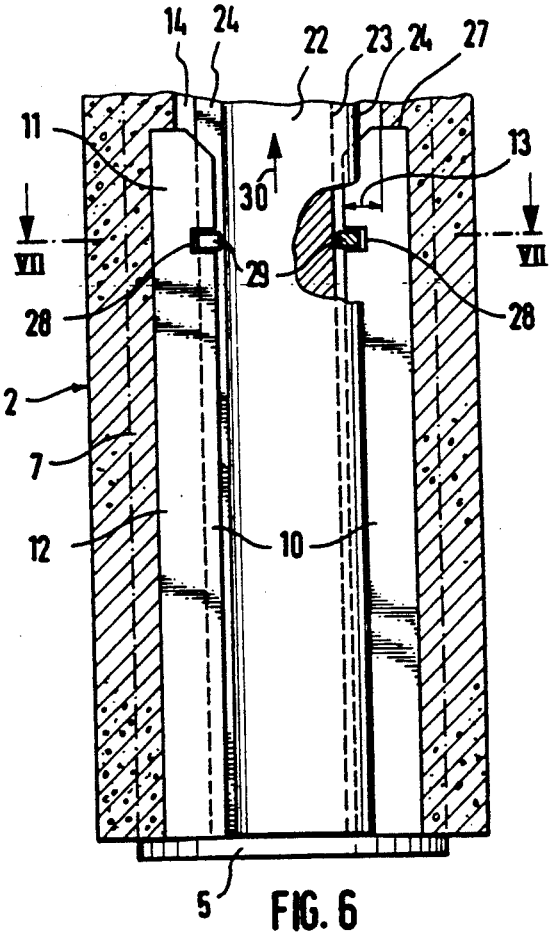
FIG. 6 is an additional configuration of the invention in a section taken through line VI—VI in FIG. 7.
Figure 7:
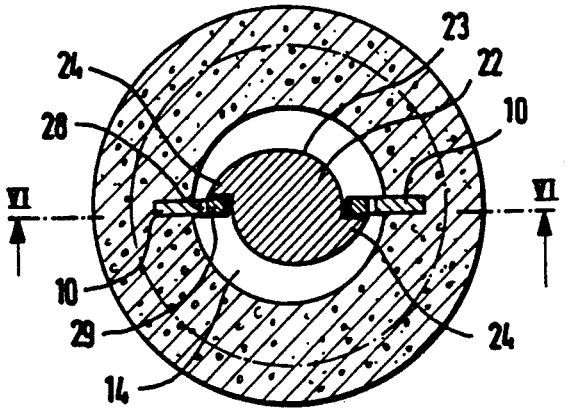
FIG. 7 is a cross-sectional view taken through line VII—VII in FIG. 6.

FIGS. 6 and 7 show another embodiment in which notches 28 are provided in opposite arrangement in the region of the upper ends 27 of the flat steel bars 10 in the part 12 of the flat steel bars 10 protruding into the inner cavity. In a corresponding manner, external projections 29, which are intended to engage the notches 28, are fixed to the outer wall 23 of the driver rod 20 in order to be able to transfer a corresponding tensile force in the direction of the arrow 30 to the pile 1 from the driver rod. The driver rod 22 has one rotatable position, as shown in FIGS. 6 and 7, in which the projections 29 engage the notches 20 so that the driver rod 20 can lift the pile as indicated by the arrow 30 in FIG. 6 and another rotatable position in which the projections 29 are circumferentially spaced from the notches 20.

What I claim is:

1. A pile adapted to be driven into the ground by a pile driving rod, comprising an elongated cast structure having a longitudinal bottom end portion and a longitudinal top end portion, said bottom end portion going into the ground first, said cast structure having an internal elongated passage extending the axial extent of said cast structure and which receives said driving rod, said cast structure having external threads extending along the axial extent of said bottom end portion, metal engaging means embedded in said bottom end portion of said cast structure and extending the axial extent of said bottom end portion such that said metal engaging means is disposed radially inwardly of said external threads, said metal engaging means comprising at least two elongated and diametrically opposed flat metal bars extending partially into said internal passage along the axial extent of said bottom end portion of said cast structure and engageable by said driving rod to enable said driving rod to apply a torque to said pile and thereby drive said pile into the ground.

2. A pile according to claim 1, wherein said cast structure is a concrete structure.

3. A pile according to claim 1, wherein said cast structure is a centrifugally cast concrete structure.

4. A pile according to claim 1 further comprising a foot plate means having cutters disposed at the bottom longitudinal end of said pile, said foot plate means being connected to said metal engaging means.

5. A pile according to claim 4, wherein said foot plate means comprising a plate which is generally perpendicular to the axis of the pile, said plate having an inner surface and an outer surface, said cutters being on said outer surface, said metal engaging means being connected to said inner surface.

6. A pile according to claim 4, wherein welding means connects said foot plate means to said metal engaging means.

7. A pile according to claim 1, wherein said metal engaging means comprises a plurality of axially spaced rings, said elongated flat metal bars being connected to said spaced rings, said spaced rings being at least partially embedded in said cast structure.

8. A pile according to claim 1, wherein each of said elongated flat metal bars extend longitudinally parallel to the axis of said internal passage, each of said flat metal bars having a radial inner wall and a radial outer wall with the radial distance between said inner and outer radial walls defining the radial width of each flat metal bar, each of said flat metal bars having approximately one half of said radial width embedded in said cast structure and approximately one half of said radial width extending generally radially into said internal passageway.

9. A pile according to claim 1, wherein said internal passage extends the entire longitudinal length of said pile.

10. The combination comprising a pile and a pile driving rod for driving the pile into the ground, said pile comprising an elongated cast structure having a longitudinal bottom end portion and a longitudinal top end portion, said bottom end portion going into the ground first, said cast structure having an internal elongated passage extending the axial extent of said cast structure and which receives said driving rod, said cast structure having external threads extending along the axial extent of said bottom end portion, metal engaging means embedded in said bottom end portion of said cast structure and extending the axial extent of said bottom end portion such that said metal engaging means is disposed radially inwardly of said external threads, said metal engaging means comprising at least two elongated and diametrically opposed flat metal bars extending partially into said internal passage along the axial extent of said bottom end portion of said cast structure and engageable by said driving rod to enable said driving rod to engage said flat metal bars to apply a torque to said pile and thereby drive said pile into the ground.

11. The combination according to claim 10, wherein said driving rod has an outer diameter approximately equal to the diameter of said internal passage, said driving rod having longitudinal grooves, said flat metal bars being received in said grooves.

12. The combination according to claim 10, wherein said flat metal bars have notches, said driving rod having projections which are received in said notches.

13. The combination according to claim 12, wherein said projections engage said notches to thereby enable lifting of said pile by said driving rod.

14. The combination of claim 12, wherein said projections on said driving rod are engaged with said notches by rotating said driving rod relative to said flat metal bars.

15. The combination according to claim 10, wherein said driving rod has an outer cylindrical surface having a diameter less than the diametrical spacing between said two diametrically spaced flat metal bars, said driving rod having drivers which extend radially outwardly of said cylindrical surface of said driving rod for engaging said flat metal bars.

16. The combination of claim 10, wherein said flat metal bars have notches opening up to the inner radial end of said flat metal bars, said driving rod having circumferentially spaced projections, said driving rod having one rotatable position in which said projections are circumferentially spaced from said notches and another rotatable position in which said projections engage said notches.

17. The combination according to claim 10, wherein said external threads extend over a first axial length of said pile, said flat metal bars extending over a second axial length of said pile, said second axial length being at least as long as said first axial length.

* * * * *